US005413362A

United States Patent [19]

De Santis

[11] Patent Number: 5,413,362

[45] Date of Patent: May 9, 1995

[54] FRONT WHEEL BRAKE FOR ROLLER SKATE

[76] Inventor: Mario De Santis, 234 Raymerville Dr., Markham Ontario, Canada, L3P 6S2

[21] Appl. No.: 238,351

[22] Filed: May 5, 1994

Related U.S. Application Data

[63] Continuation of Ser. No. 45,112, Apr. 12, 1993, abandoned.

[30] Foreign Application Priority Data

Jul. 24, 1992 [CA] Canada ..... 2074587

[51] Int. Cl.[6] ..... A63C 17/14

[52] U.S. Cl. ..... 280/11.2; 280/11.22; 188/29

[58] Field of Search ..... 280/11.2, 11.22, 11.23; 188/29, 74

[56] References Cited

U.S. PATENT DOCUMENTS

| | | | |
|---|---|---|---|
| 1,456,881 | 5/1923 | Carley | 280/11.2 |
| 5,088,748 | 2/1992 | Koselka et al. | 280/11.2 |
| 5,183,275 | 2/1993 | Hoskin | 280/11.2 |
| 5,192,099 | 3/1993 | Riutta | 280/11.22 X |
| 5,207,438 | 5/1993 | Landers | 280/11.2 |
| 5,308,093 | 5/1994 | Walin | 280/11.2 |

FOREIGN PATENT DOCUMENTS

| | | | |
|---|---|---|---|
| 0379906 | 8/1990 | European Pat. Off. | 280/11.2 |
| 0062701 | 10/1948 | Netherlands | 280/11.2 |
| 8200770 | 3/1982 | WIPO | 280/11.2 |
| 8911894 | 12/1989 | WIPO | 280/11.2 |

*Primary Examiner*—Margaret A. Focarino
*Assistant Examiner*—Peter C. English

[57] ABSTRACT

A roller skate with a plurality of skate rollers including a front roller has a front end brake comprising a brake wheel forwardly of the front roller with a braking member between the brake wheel and the front roller. The brake wheel has a lower reach above that of the front roller when the skate is in the rolling position on the rollers and the brake wheel in a brake released position. The brake wheel is movable rearwardly against the brake member to a braking position when the skate is tipped forwardly away from the rolling position onto the brake wheel. A spring is provided which moves the brake wheel back to the brake released position when the skate is returned to the rolling position.

7 Claims, 3 Drawing Sheets

FRONT WHEEL BRAKE FOR ROLLER SKATE

This is a continuation of patent application Ser. No. 08/045,112, filed Apr. 12, 1993, now abandoned in favor of this continuation application.

FIELD OF THE INVENTION

The present invention relates to a roller skate with a front mounted brake.

BACKGROUND OF THE INVENTION

Prior art methods of braking the forward motion of old style roller skates use a friction pad fixed forwardly and downwardly to the front of the boot which allows the operator to slow forward motion or to stop by merely raising the heel of the boot causing the friction pad to contact the road surface.

More recently, skates referred to as in-line skates which generally can be operated with greater dexterity than the older roller type skates have rearwardly mounted friction pads which are operated by raising the toe of the boot to thereby stop the motion from the rear. The disadvantage encountered in this motion is the tendency of the operator to over-balance and fall backwards which can result in serious back and head injury.

A recent development in the braking for roller skates is disclosed in U.S. Pat. No. 5,088,748 where a brake wheel is provided behind the in-line roller wheels and is operated by the lifting of the boot front. This puts the extra brake wheel into contact with the road surface biasing a pivotal connection between linkage bars attached to the skate boot and roller wheel bracket where lifting action controlled by the skate operator actuates the brake on the extra wheel. Once again, the operator must lean backwards to a dangerous position in order to operate the brake of this patented construction.

SUMMARY OF THE INVENTION

The present invention provides a roller skate with a front as opposed to a rear operated brake so that when the skate is moved to the braking position, the operator does not have to lean rearwardly to a dangerous position on the skate.

More particularly, the skate with brake of the present invention comprises a plurality of rollers including a front roller beneath a skate boot. Provided forwardly of the front roller is a front brake wheel which is elevated from the ground in a brake released position when the skate is rolling on the rollers. A brake member is disposed between the front wheel and the front roller and the front wheel is movable rearwardly against the brake member to provide a braking action on the skate when the operator raises the heel as opposed to the toe of the skate. A spring is also provided in the brake and when the operator lowers his or her heel so that the skate once again assumes its normal rolling position, the front wheel is moved by the spring to the brake released position away from the brake member.

BRIEF DESCRIPTION OF THE DRAWINGS

The above as well as other advantages and features of the present invention will be described in greater detail according to the preferred embodiments of the present invention in which.

Figure 1:
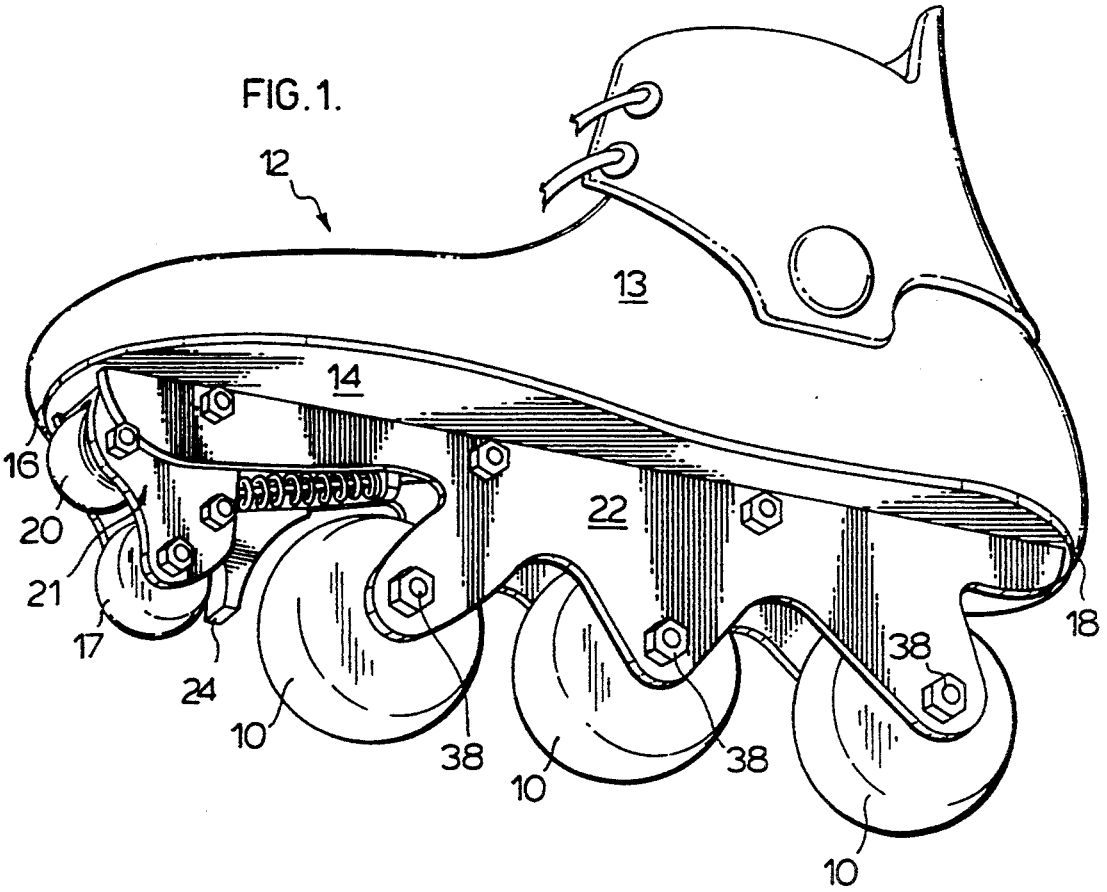
FIG. 1 is a perspective view of a roller skate with a front mounted brake according to a preferred embodiment of the present invention.

DETAILED DESCRIPTION ACCORDING TO THE PREFERRED EMBODIMENTS OF THE PRESENT INVENTION

A roller skate is provided in which in-line running rollers collectively designated at 10 are arranged in single file centrally of a skate generally indicated at 12. A boot 13 consisting of a sole plate 14 has a front end 16 and a heel portion 18.

The skate consists of a platform comprising the sole plate 14 with a pair of parallel spaced apart wheel support plates 22 along the horizontal axis of the skate between the front 16 and the rear 18 of the sole plate 14. Axle shafts 38 extend between adjacent support plates 22 to provide rotatable mounts for the roller 10 which rotate freely when the skate is rolling along a rolling surface for the skate. Two wheels 17 and 20 smaller than the rollers are positioned at the front of the skate. The lower reaches of these two wheels are elevated relative to the lower reach of the front roller and are free of the running surface 40 when the skate is operated in the normal fashion with all rollers 10 in contact with the road surface 40. The two small wheels 17 and 20 are mounted on axles 36, 33 journalled in a U-shaped bracket 21 which is pivotally fitted at 28 to a spring support 30 fixed to sole plate 14. The pivotal mounting of bracket 21 ensures that this bracket carrying wheels 17 and 20 will move rearwardly when the skate is tipped forwardly and wheel 17 is pushed downwardly onto the running surface 40.

Figure 2:
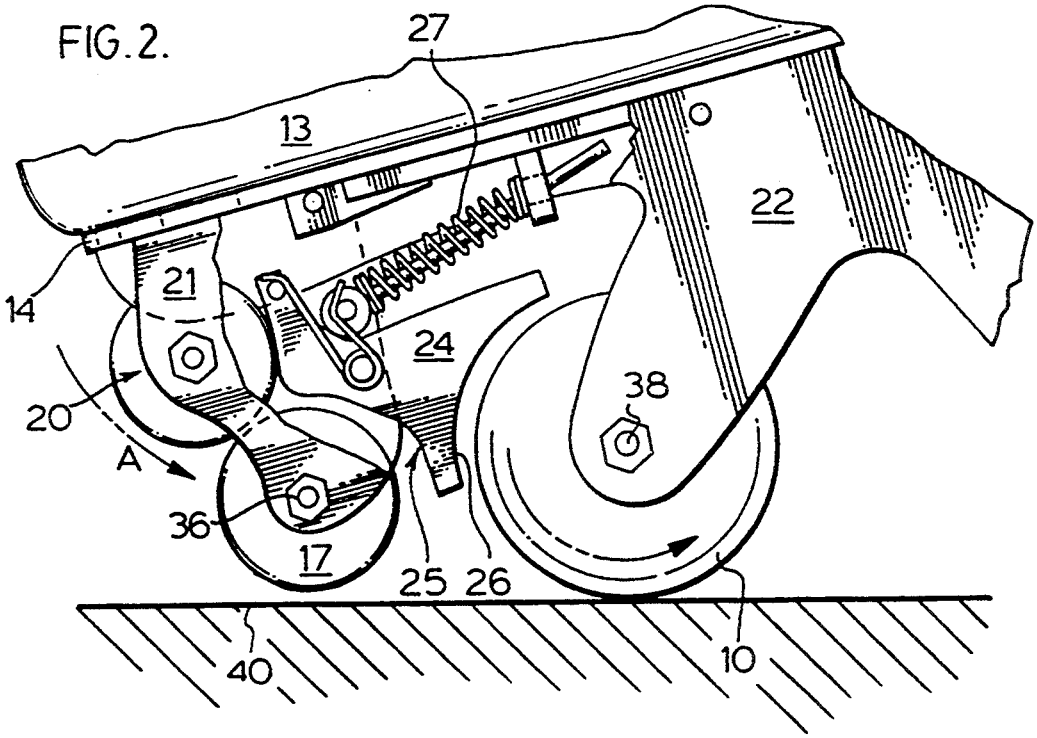
FIG. 2 is an enlarged partially sectioned view of the front brake area from the skate of FIG. 1 with the brake in its released position.

A wedge shaped brake member 24 is located between the brake wheel 17 and the front roller 10. This brake member has a forward rounded brake surface 25 and a rearward rounded brake surface 26. The brake member is pivotally mounted to the bracket 21 above the brake surfaces with a spring 27 trapped between the upper end of the brake member above its pivot point and a spring stop 32 on the base of the spring support 30. A further smaller clip like spring 35 is also mounted on the brake member 24 and normally urges the upper part of the brake member against wheel 20 and the lower part of the brake member off of wheel 17 when the skate is in its normal rolling position. As will be seen in FIG. 2 of the drawings, wheel 17 when it is not in the braking position is freely rotatable.

Figure 3:
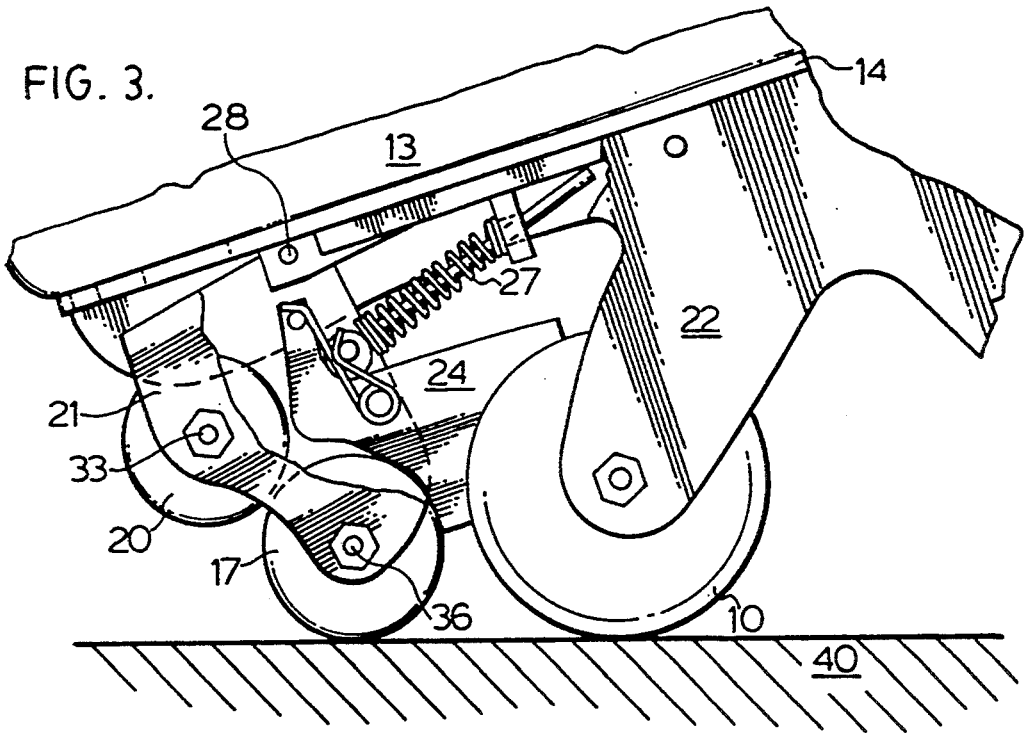
FIG. 3 is a view similar to FIG. 2 with the skate tipped forwardly moving the brake to the engaged position.
Figure 4:
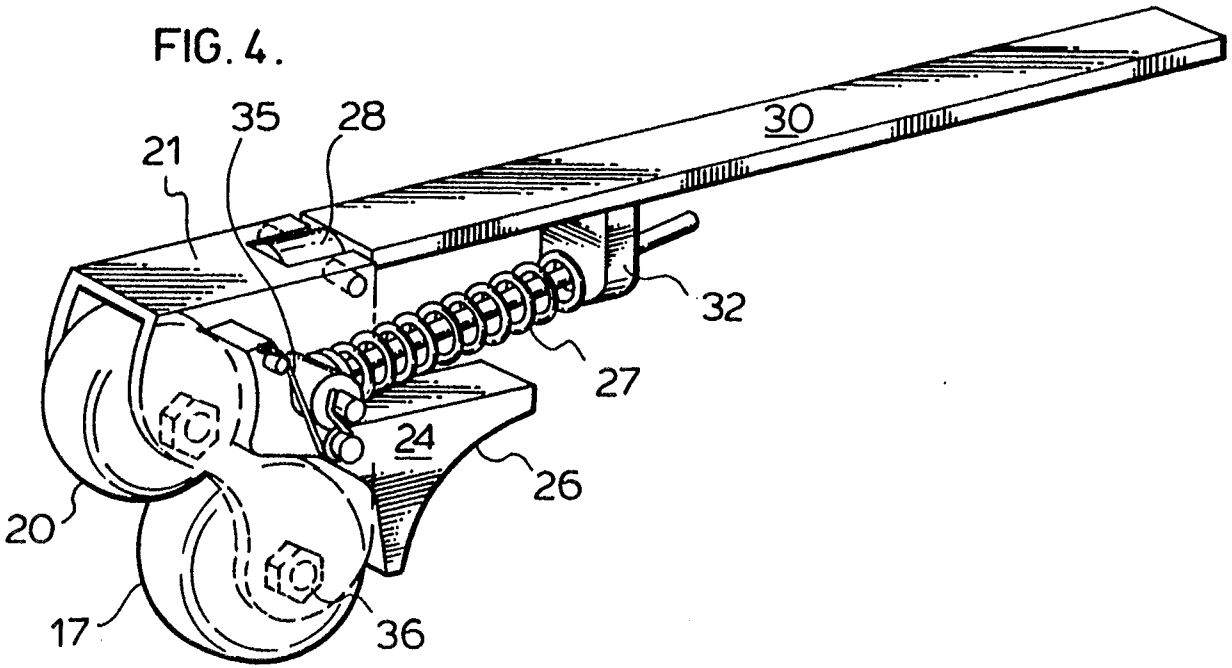
FIG. 4 is a perspective view of the actual brake assembly removed from the skate of FIG. 1.

When the skate is tipped forwardly onto brake wheel 17 as shown in FIG. 3 of the drawings, bracket 21 carrying the brake wheel is pivoted rearwardly against the pressure of spring 27 so that the surface of the brake wheel engages the forward arcuate surface 25 of brake member 24. This provides a frictional braking of wheel 17. The brake wheel 17 in turn applies a rearward pressure on the brake member 24 such that the brake member 24 is then pushed rearwardly to the point where its rearward arcuate braking surface 26 engages the periphery of front roller 10 further adding to the braking action on the skate. FIG. 3 also shows that the force applied by wheel 17 on the brake member 24 causes the upper end of the brake member 24 to pull away from wheel 20. This wheel 20 becomes freely rotatable and provides a safety wheel if the skate is tipped too abruptly because the operator, rather than pitching forwardly will have his or her weight applied to the now free wheeling safety wheel 20. In fact, the operator can rock the skate when it is-tipped forwardly between the wheels 20 and 17 which starts to release from the braking position when the weight of the skater is on wheel 20 which allows the operator to slow down the rolling action and finally stop the skate gradually rather than coming to an abrupt stop.

As soon as the skate is moved back to its normal rolling position, spring 27 pushes bracket 21 about its pivot 28 so that the bracket carries the two wheels 17 and 20 forwardly such that wheel 17 releases from the front of the brake member 24. Spring 35 then pushes the upper part of the brake member 24 back onto the most forward wheel 20 Which pivots the lower part of the brake member 24 off of the brake wheel 17.

The spring action of the brake also allows it to be rocked between the brake wheel 17 and the front roller 10 to once again gradually control the braking action on the skate.

Although various preferred embodiments of the present invention have been described herein in detail, it will be appreciated by those skilled in the art, that variations may be made thereto without departing from the spirit of the invention or the scope of the appended claims.

What is claimed is:

1. A roller skate with a front end brake on said skate, said skate having a skate boot with a boot undersurface and a rigid frame secured to said undersurface, a plurality of rollers comprising a front roller and other rollers behind and inline with said front roller, all of said rollers being rotatably mounted on roller axles secured to said rigid frame, said brake comprising a brake wheel rotatbly mounted on a brake wheel mount which is movably secured to said boot undersurface forwardly of said front roller, a brake member secured to said boot undersurface between and spaced from said brake wheel and said front roller, said skate being movable between a rolling position in which all of said rollers roll along a rolling surface on which said skate is supported to a braking position in which said skate is tipped forwardly from said rolling position onto said brake wheel, said brake wheel having a peripheral surface with a lower reach above that of said front roller and being freely rotatable and free of the rolling surface when said skate is in the rolling position and when said skate is in the braking position, said brake wheel is pushed rearwardly such that said peripheral surface of said brake wheel is moved onto and binds against rotation on said brake member; and a spring mounted on a spring support to said boot undersurface, said spring pushing on said brake wheel mount in a direction away from said front roller and biasing said brake wheel away from said front roller when said skate is in the rolling position.

2. A skate as claimed in claim 1 wherein said brake wheel is smaller than said front roller.

3. A skate as claimed in claim 1, wherein said brake wheel mount comprises a bracket pivotally secured to said boot undersurface.

4. A skate as claimed in claim 1, wherein said brake member is movably mounted on said boot undersurface and wherein said brake wheel when in the braking position pushes said brake member onto said front roller.

5. A skate as claimed in claim 4, wherein said brake member has a forward arcuate surface facing said brake wheel and a rearward arcuate surface facing said front roller.

6. A skate as claimed in claim 1, including a second wheel rotatably held in said brake wheel mount above and forwardly of said brake wheel.

7. A skate as claimed in claim 1, wherein said front end brake is located in a position directly beneath said skate boot.

* * * * *